United States Patent [19]

Trusch

[11] Patent Number: 5,024,060

[45] Date of Patent: Jun. 18, 1991

[54] JOULE-THOMSON REFRIGERATION CYCLE EMPLOYING A REVERSIBLE DRIVE ELECTROCHEMICAL COMPRESSOR

[75] Inventor: Raymond B. Trusch, South Windsor, Conn.

[73] Assignee: United Technologies Corporation, Hartford, Conn.

[21] Appl. No.: 544,551

[22] Filed: Jun. 27, 1990

[51] Int. Cl.[5] ..... F25B 19/02

[52] U.S. Cl. ..... 62/51.2; 62/467; 417/48

[58] Field of Search ..... 62/51.2, 467; 417/48

[56] References Cited

U.S. PATENT DOCUMENTS 4,593,534 6/1986 Bloomfield ..... 62/467

4,671,080 6/1987 Gross ..... 62/467

*Primary Examiner*—Ronald C. Capossela

*Attorney, Agent, or Firm*—Donald S. Holland

[57] ABSTRACT

A Joule-Thomson refrigeration cycle is disclosed having an electrochemical compressor with a solid polymer electrolyte membrane. The cycle includes a reversible drive power source for pumping working fluid in opposite directions through the compressor, thereby insuring that the membrane is continuously hydrated.

13 Claims, 1 Drawing Sheet

JOULE-THOMSON REFRIGERATION CYCLE EMPLOYING A REVERSIBLE DRIVE ELECTROCHEMICAL COMPRESSOR

BACKGROUND OF THE INVENTION

The present invention is drawn to a refrigeration cycle and, more particularly, to a Joule-Thomson refrigeration cycle which employs an electrochemical compressor having a solid polymer electrolyte.

Joule-Thomson refrigeration cycles are well known in the art and have been the subject of much study in the last few years. The basic principle of the Joule-Thomson refrigeration cycle resides in pumping a gaseous working fluid (e.g., hydrogen) at high pressure through a series of heat exchangers and a Joule-Thomson (J-T) valve. Expansion of the gas at the J-T valve results in a net cooling effect, which lowers the fluid's temperature to levels near or at the liquefaction point.

It has been proposed in the prior art to use an electrochemical compressor to drive a Joule-Thomson refrigeration cycle. See, for example, U.S. Pat. No. 4,593,534 to Bloomfield. Ideally, this type of compressor is preferred since it has no moving parts. The system is therefore vibration free and has the potential for long life and high reliablity.

A typical electrochemical compressor comprises a first electrode, wherein the working fluid having an electrochemically active component, generally hydrogen, is oxidized; a second electrode, wherein the electrochemically active component is reduced; and an electrolyte which serves to conduct the ionic species. The electrolyte is generally a solid ion exchange membrane such as NAFION, a solid polymer electrolyte manufactured by E. I. Du Pont de Nemours & Co., Inc. of Wilmington, DE.

Operation of the electrochemical compressor is as follows. Low-pressure hydrogen at the compressor inlet is ionized at the first electrode by removal of the electrons. The hydrogen ions, protons, are then transported via a voltage potential across the electrolyte membrane. At the second electrode, the protons are recombined with their electrons to form hydrogen. Platinum, provided as a catalyst at each electrode, facilitates the reduction and oxidation reactions. Hydrogen is transported through the membrane in direct proportion to the electrical current.

When operating the electrochemical compressor, the solid polymer membrane must be hydrated. Otherwise, the cell performance will seriously degrade with time.

Applicant has recognized a dehydration problem. Moisture is, unfortunately, continuously removed from the membrane as the gas passes through it. Since contaminates, such as water, cannot be tolerated in a Joule-Thomsom refrigeration cycle, the gas is then passed through a sorbent bed. There, the carried moisture is condensed and frozen out, or absorbed.

Applicant has determined that the cell's efficiency and useful life will be prolonged if the membrane is continuously wetted, or hydrated. It would therefore be highly desirable to provide a Joule-Thomson refrigeration cycle, employing an electrochemical compressor, which allows for its solid polymer electrolyte membrane to be continuously hydrated by water carried in the working fluid.

Accordingly, it is the principal object of the present invention to provide an improved Joule-Thomson refrigeration cycle in which this constant wetting of the polymer member is achieved by a condensable component in the working fluid.

It is a particular object to provide a refrigeration cycle, which employs regenerable sorbent means upstream and downstream of the electrochemical compressor for removing water from the high-pressure working fluid and replacing water into a low-pressure working fluid.

It is another object to provide a refrigeration cycle, commenstrate with the above-listed objects, wherein the electrochemical compressor is driven by a reverse-polarity power source so as to selectively reverse gas flow through the compressor in the refrigeration cycle.

The above and other objects and advantages of this invention will become more readily apparent when the following description is read in conjunction with the accompanying drawing.

SUMMARY OF THE INVENTION

As noted above, the present invention is drawn to a Joule-Thomson refrigeration cycle which employs a electrochemical compressor having a solid polymer electrolyte and, more particularly, a Joule-Thomson cycle employing a reverse-polarity power source for driving the electrochemical compressor selectively, in opposite directions, so as to maintain the membrane in a hydrated condition.

In accordance with the present invention, he refrigeration cycle comprises an electrochemical compressor having a low-pressure side and a high-pressure side, and an electrolyte membrane positioned between the high- and low-pressure sides of the compressor. The working fluid driven by the electrochemical compressor comprises a electrochemically active component selected from the group consisting of oxygen, hydrogen, and an element selected from the Group VIIA of the Periodic Table and a condensable component, such as, in the preferred embodiment, water. A reverse-polarity power source is provided for driving the electrochemical compressor for receiving working fluid at the low-pressure side, compressing the working fluid and delivering the compressed working fluid to the high-pressure side of the compressor. The polarity of the power source may be reversed for driving the working fluid in opposite directions through the refrigeration cycle.

In the preferred embodiment, a first regenerable sorbent bed is provided downstream of the high-pressure side for receiving fluid from the compressor and removing the condensable component of the working fluid from the compressed gas stream. A second regenerable sorbent bed is located upstream of the low-pressure side of the compressor for replacing the condensable component back into the working fluid prior to that fluid being fed to the compressor. By reversing the polarity of the power source, the condensable component of the working fluid continually wets the electrolyte membrane of the electrochemical compressor.

In addition, a heat exchanger or heat sink is located between the first and second regenerable sorbent beds. First and second Joule-Thomson expansion valves are provided upstream and downstream of the heat load at a relatively constant temperature. A reverse-flow heat exchanger is provided between the sorbent beds and the J-T valves.

The disclosed refrigeration cycle allows for continuous operation, while assuring that the solid polymer electrolyte membrane is continually wetted by water, by simply reversing the polarity of the electrochemical compressor.

BRIEF DESCRIPTION OF THE DRAWING

The sole FIGURE (FIG. 1) is a schematic illustration of a refrigeration cycle in accordance with the present invention.

DETAILED DESCRIPTION OF THE PREFERRED EMBODIMENTS

Figure 1:
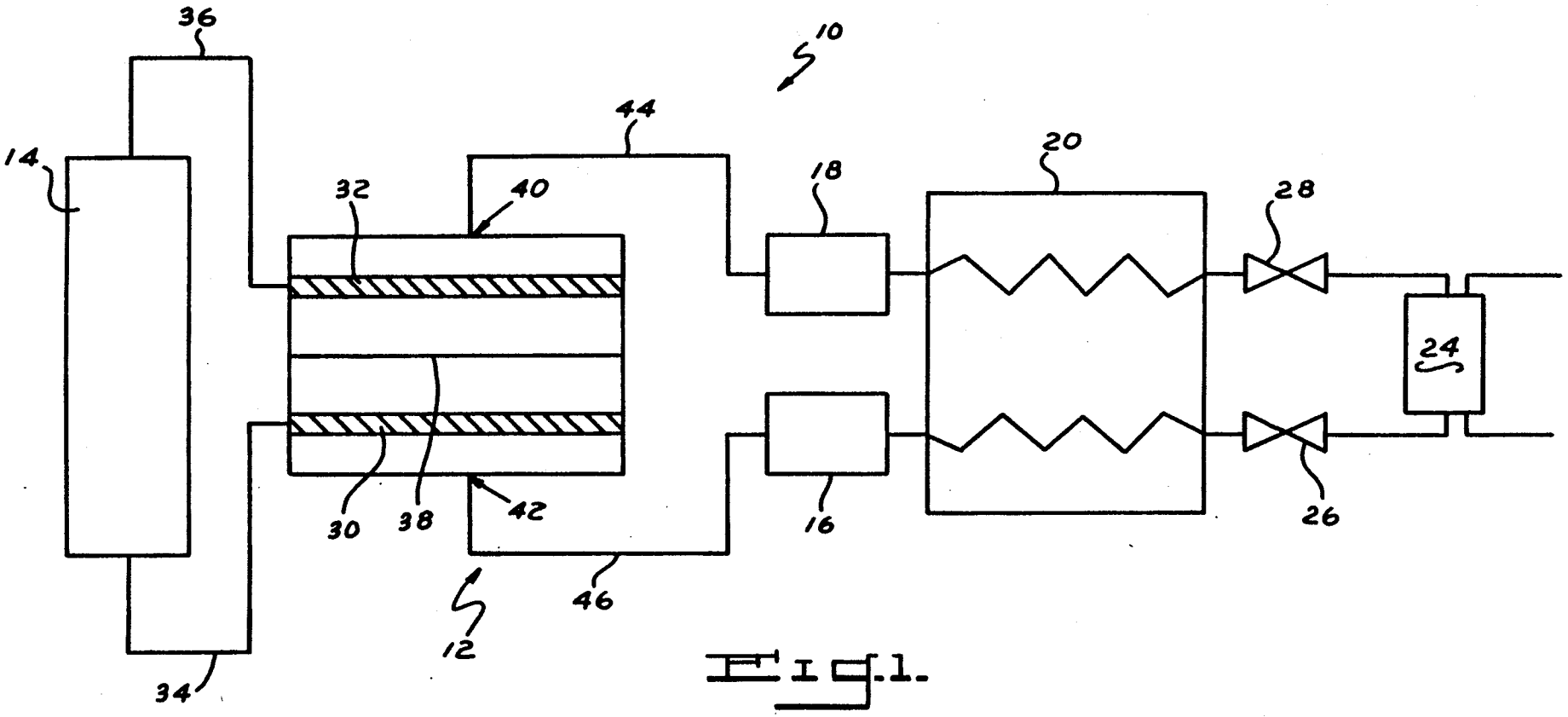

A Joule-Thomson refrigeration cycle 10, constructed in accordance with the present invention is illustrated in FIG. 1. The refrigeration cycle 10 basically comprises a electrochemical compressor 12, which is driven by a reverse-polarity power source 14; a pair of regenerable sorbent beds 16, 18, located upstream and downstream of the compressor 12; a regenerative heat exchanger 20 located between the sorbent beds 16, 18 and a heat sink 24; and a pair of Joule-Thomson expanders 26, 28 located upstream and downstream of the heat sink, between the heat sink 24 and the regenerative heat exchanger 20.

The preferred electrochemical compressor 12 comprises a first porous electrode 30, provided with a platinum catalyst, and a second porous electrode 32, also provided with a platinum catalyst. These electrodes 30, 32 are connected to the reverse-polarity power source 14 by power leads 34, 36; and a solid polymer electrolyte membrane 38 is provided between the electrodes. The preferred solid polymer electrolyte membrane 38 is made from the polymer material manufactured by Du Pont and sold under the trademark NAFION, namely, sulfonated perfluorocarbon polymer.

The working fluid in cycle 10 is an electrochemically active component selected from the group consisting of oxygen, hydrogen and Group VIIA elements of the Periodic Table. Hydrogen is the preferred working fluid.

The working fluid contains a condensable component—but this is basically true only at the compressor end. At the J-T expander end, the fluid is essentially only the active component (e.g., hydrogen or oxygen) with only traces of moisture. The cycle's operation will now be discussed in detail, with reference to a working fluid comprising hydrogen and water. As the electrochemical compressor cell 12 is symmetrical, reversing electrode polarity of the cell 12 by the power source 14 will result in reversal of the pumping direction of the gaseous hydrogen. Assuming that the polarity of source 14 is such that electrode 32 forms the anode and electrode 30 the cathode, 40 would be the low-pressure side of the compressor 12 and 42 the high-pressure side. With the electrochemical compressor 12 operating in this manner, working fluid would enter the low-pressure side 40 of the compressor via conduit 44. The working fluid contacts electrode 32, now acting as the anode, and the electrochemical species of the working fluid, such as hydrogen, is oxidized to hydrogen ions at the electrode 32. The hydrogen ions are then transported via voltage potential across the solid polymer electrolyte membrane 38. The condensable component of the working fluid, that is, water, enters the electrolyte membrane where it surrounds the hydrogen ions, thereby forming a hydration sheath. As the electrons pass from the anode 32 to the cathode 38, the hydrogen ions in the electrolyte, along with the water of the hydration, pass from the anode to the cathode. The hydrogen gas passed over the hydrated membrane will contain water vapor in a concentration approximately equal to the vapor pressure of water at a given saturation temperature. Moisture (water) will be removed from the membrane at a rate dependent on hydrogen flow. As a result, the hydrogen gas leaving the high-pressure side 42 of the compressor is essentially saturated with water vapor. As the Joule-Thomson orifice/expander cannot tolerate contaminants, such as water, the saturated gas is passed through conduit 46 to a first regenerable sorbent bed 16 There, the water is removed from the working fluid stream prior to passing the working fluid stream through reverse-flow heat exchanger 20 and Joule-Thomson expander valve 26, and ultimately to heat sink 24. The reduction in pressure affected by the expansion of fluid in Joule-Thomson expansion valve 26 results in a net cooling effect which lowers the hydrogen temperature for transfer to heat sink 24. The working fluid leaving heat sink 24 is then returned to the electrochemical compressor 12 via the reverse-flow heat exchanger 20 regenerable sorbent bed 18 and conduit 44.

As can be seen from the foregoing, during the operation of the refrigeration cycle, water vapor is removed from the solid polymer electrolyte membrane 38 and is captured in sorbent bed 16. In accordance with the present invention, to maintain the solid-polymer electrolyte membrane wetted, the polarity of the electrochemical compressor 12 can be reversed via power source 14 to allow hydrogen to be pumped in the opposite direction. Upon reversal of the polarity, 42 becomes the low-pressure side of compressor 12, and 40 becomes the high-pressure side of compressor 12. In this operation, sorbent bed 16, which was previously picking up moisture at the high-pressure side of the compressor, now contacts low-pressure dry gas returning to the cell from heat sink 24. This low-pressure dry gas effectively desorbs and regenerates the bed 16; and moisture is absorbed into the working fluid stream carried via conduit 46 to the low-pressure side 42 of the electrochemical compressor 12. This returns water vapor to the compressor 12, which wets the electrolyte membrane 38. Thus, by selectively reversing the polarity of power source 14, the compressor can be driven in opposite directions, thereby assuring that the solid polymer membrane 38 is continuously wetted with the condensable component of the working fluid; and the sorbent beds are periodically regenerated.

In accordance with the present invention, standard dual expansion valves 26, 28 (such as orifices or capillary tubes) are employed in the refrigeration cycle. By using such dual thermal expansion means, the Joule-Thomson expansion temperature drop occurs in sequential steps, which allows the heat sorbent 18 to accept the heat load at a relatively constant temperature. This is preferable to a single Joule-Thomson expansion valve which would result in large temperature variations upon flow reversal.

As noted above, the moisture removed from the membrane is dependent on the hydrogen pumped gas flow rate. Once the flow rate is established, it can readily be established when reversal of polarity should be carried out to insure that the solid polymer electrolyte membrane is always sufficiently wetted with a condensable component of the working fluid.

As can be seen from the foregoing, the refrigeration cycle of the present invention offers a simple and economical mechanism for running a Joule-Thomson refrigeration cycle, which employs a electrochemical compressor having a solid polymer electrolyte membrane.

It should be understood, by those skilled in the art, that obvious modifications can be made to the described embodiments without departing from the spirit of the invention. For example, a regenerative, counter-flow heat exchanger could be substituted for the sorbent beds 16, 18 and heat sink 24. Accordingly, reference should be made primarily to the accompanying claims, rather than the foregoing specification, to determine the scope of the invention.

Having thus described the invention, what is claimed is:

1. A refrigeration cycle comprising: an electrochemical compressor having a low-pressure side, a high-pressure side and an electrolyte membrane between the low-pressure side and the high-pressure side; a working fluid having an electrochemically active component and a condensable component; a reverse-polarity power source for driving the electrochemical compressor for receiving working fluid at the low-pressure side, compressing the working fluid and delivering the compressed working fluid to the high-pressure side; a first regenerable sorbent bed downstream of the high-pressure side for receiving the compressed working fluid from the compressor and absorbing the condensable component therefrom; a second regenerable sorbent bed upstream of the low-pressure side for replacing the condensable component into the working fluid prior to the working fluid being fed to the low-pressure side of the compressor; a heat exchanger located between the first and second regenerable sorbent beds; a first thermal expansion means provided between the first regenerable sorbent bed and the heat exchanger; a second thermal expansion means provided between the second regenerable sorbent bed and the heat exchanger; and means for selectively reversing the polarity of the power source and correspondingly the flow of working fluid through the refrigeration cycle, thereby insuring that the electrolyte membrane is constantly wetted by the condensable component.

2. A refrigeration cycle according to claim 1 wherein the condensable component is water.

3. A refrigeration cycle according to claim 2 wherein the electrochemically active component is selected from the group consisting of hydrogen, oxygen and an element selected from Group VIIA of the Periodic Table.

4. A refrigeration cycle according to claim 1 wherein the electrolyte membrane is a solid polymer membrane.

5. A refrigeration cycle according to claim 4 wherein the electrolyte membrane is sulfonated perfluorocarbon polymer.

6. A refrigeration cycle according to claim 2 wherein the active component is hydrogen.

7. A refrigeration cycle according to claim 1 wherein a reverse-flow heat exchanger is located between the first and second sorbent beds for receiving working fluid from one of the sorbent beds and passing working fluid to the other of the sorbent beds.

8. A refrigeration cycle according to claim 1 wherein the thermal expansion means are capillary tubes.

9. A refrigeration cycle according to claim 1 wherein the thermal expansion means are orifices.

10. In a Joule-Thomson refrigeration cycle employing an electrochemical compressor having a solid polymer electrolyte membrane, a process for continuously wetting the solid polymer electrolyte membrane comprising: providing a working fluid having an electrochemically active component and a condensable component, pumping the working fluid in a first direction through the electrochemical compressor thereby compressing the working fluid, absorbing the condensable component from the compressed working fluid in a sorbent bed, and thereafter reversing the direction of pumping fluid, whereby the condensable component is delivered into the working fluid from the sorbent bed for wetting the solid polymer electrolyte membrane as the working fluid is pumped through the electrochemical compressor.

11. A process according to claim 10 wherein the electrolyte membrane is sulfonated perfluorocarbon polymer.

12. A process according to claim 10 wherein the condensable component is water.

13. A process according to claim 10 wherein the active component is hydrogen.

* * * * *